United States Patent [19]

Allen

[11] 3,949,868

[45] Apr. 13, 1976

[54] CARTON WITH HEAT SHRINKABLE WINDOW AND BLANK FOR PRODUCING SAME

[75] Inventor: R. H. Allen, Memphis, Tenn.

[73] Assignee: Eastex Packaging, Inc., Oak Brook, Ill.

[22] Filed: Sept. 16, 1974

[21] Appl. No.: 506,580

[52] U.S. Cl. ..... 206/45.34; 206/497; 206/521; 206/45.14; 206/471; 229/14 BL

[51] Int. Cl.[2] B65D 25/00; B65D 65/00; B65D 5/58

[58] Field of Search..... 206/45.14, 45.31, 45.33, 206/45.34, 471, 497, 521; 229/14 BA, 14 BL, 14 BW, 14 C, 37 R, 38, 15

[56] References Cited

UNITED STATES PATENTS

| | | | |
|---|---|---|---|
| 3,113,712 | 12/1963 | Kindseth | 229/14 BA |
| 3,233,818 | 2/1966 | Bixler et al. | 229/14 BA |
| 3,322,263 | 5/1967 | Gulliver | 206/521 |
| 3,334,734 | 8/1967 | Meyere | 206/45.31 |
| 3,406,814 | 10/1968 | Gulliver | 229/14 BA |
| 3,498,446 | 3/1970 | Lafreniere | 206/45.34 |
| 3,669,337 | 6/1972 | Struble | 229/14 BA |

*Primary Examiner*—William Price
*Assistant Examiner*—Douglas B. Farrow
*Attorney, Agent, or Firm*—John R. Walker, III

[57] ABSTRACT

A carton, e.g., a straight tuck style or sealable end style, intended to minimize pilferage, particularly at the retail outlet, of the product, contained therein. The carton includes a window opening which is enclosed by a transparent heat-shrinkable membrane having peripheral segments thereof secured to predetermined portions of the sidewalls, the dust flaps, and the closure flaps. The carton may optionally include shelf structure for supporting the product. The membrane structure restrains the product in an optimum orientation subsequent to the membrane being shrunk. The dust flaps define in part prominent spaces at either end of the carton which assure that the membrane is not pinched when assembling the carton, therefore, the membrane is free to totally pull away from the window as it is shrunk. Blanks for producing the above-described cartons are also disclosed herewith.

12 Claims, 12 Drawing Figures

FIG. 7
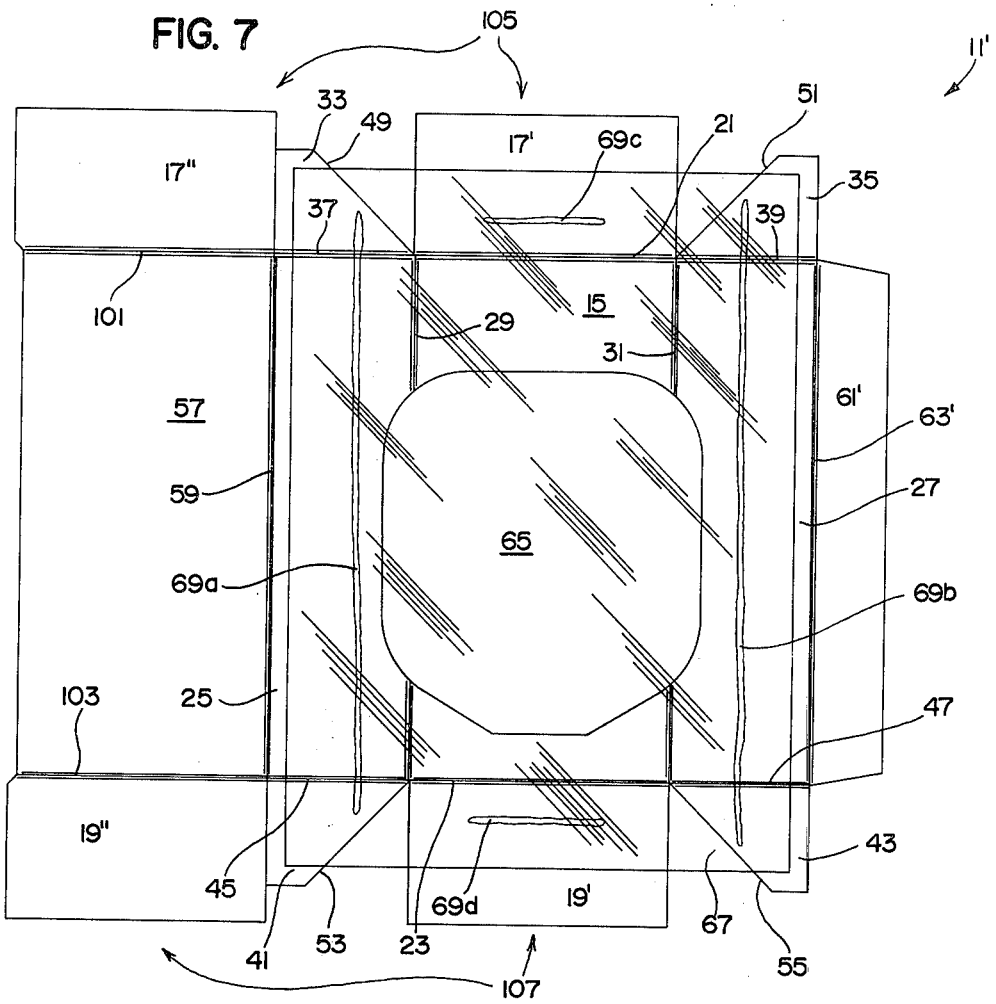
FIG. 8
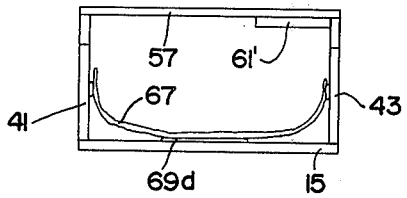
FIG. 9
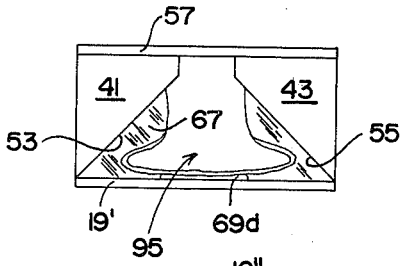
FIG. 10
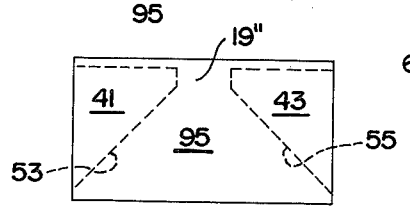
FIG. 12
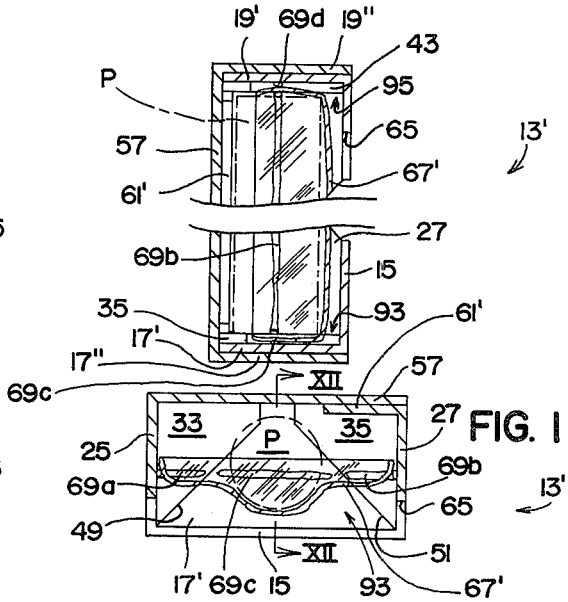
FIG. 11

CARTON WITH HEAT SHRINKABLE WINDOW AND BLANK FOR PRODUCING SAME

BACKGROUND OF THE INVENTION

1. Field of the Invention

This invention relates to cartons having heat-shrinkable membrane structure and blanks for producing these cartons.

2. Description of the Prior Art

Applicant is aware of the following U.S. patents: Gulliver, U.S. Pat. No. 3,322,263; the Watts, Jr., U.S. Pat. No. 3,540,179; the Struble, U.S. Pat. No. 3,669,337; and the Spiegel et al, U.S. Pat. No. 3,764,002. None of the above patents suggest or disclose applicant's carton or blank for producing same. However, it is significant to note that the '263 patent is specifically directed towards a gusset pack style carton and the entire peripheral margin of the heat-shrinkable membrane is glued to the various flaps. Further, the concept disclosed in the '263 patent cannot be applied to straight tuck style or seal end style cartons.

Additionally, the '337 patent is specifically directed toward a reverse tuck style carton. The entire perimeter and margin of the heat-shrinkable membrane disclosed in the '337 is also glued to the blank. However, the heat-shrinkable membrane of the '337 patent does not extend beyond the four wall panels of the blank, i.e., none of the heat-shrinkable membrane overlies any portion of the dust flaps or the tuck flaps. Additionally, the concept disclosed in the '337 patent cannot be applied to straight tuck style or seal end style cartons.

Certain problems prevail in prior straight tuck style and seal end style cartons. For example, products which are placed in these style cartons usually have an obverse portion which is intended to be presented through a window to the consumer. However, the product oftentimes rotates within the carton and is not presented in this desired manner to the consumer. Obviously, since most retail sales today are by the self-serve method, any degradation of the preferred manner in presenting the product to the consumer could adversely affect the volume of sales. Another problem concerns pilferage of the product from the carton. More specifically, a common practice by shoplifters is to remove the product from the carton which makes concealment of the stolen product easier. Pilferage from these type cartons has been rather prevalent, particularly with the straight tuck style carton. This type carton usually may easily and quickly be opened, therefore, detection of the shoplifter in the act of removing the product from the carton is difficult.

SUMMARY OF THE INVENTION

The present invention is directed toward overcoming the problems and disadvantages of previous straight tuck style and seal end style cartons, particularly those problems and disadvantages identified above. The concept of the present invention is to provide a carton which will purposely sustain damage as a result of an attempt to pilfer the product therefrom. Additionally, the product is supported in the carton in an optimum orientation with assurance that it will not subsequently be disoriented between the time it is packaged and the time it is purchased by the consumer.

The present invention is particulary directed toward improvement in straight tuck style and sealable end style cartons. The instant carton includes a window opening which is enclosed by a transparent heat-shrinkable membrane having peripheral segments thereof secured to predetermined portions of the sidewalls, the dust flaps, and the closure flaps of the carton. The carton may optionally include shelflike structure for supporting the product, or at least assist in supporting the product. The membrane structure engages and restrains the product in its optimum orientation subsequent to the membrane being shrunk. The dust flaps define in part prominent spaces at either end of the carton which assure that the membrane is not pinched when assembling the carton. Therefore, the membrane is free to totally pull away from the window as it is shrunk. Accordingly, the side walls, the dust flaps, and the closure flaps are tied together and jointly pulled inwardly, thus the carton must literally be torn into rather than just untucked to remove the product therefrom. Blanks for producing the just-described cartons are also disclosed herewith.

DESCRIPTION OF THE DRAWINGS

FIG. 7 is a plan view showing another blank incorporating another embodiment of the invention.

FIG. 8 is an end view of the partially assembled blank as depicted in FIG. 7.

FIG. 9 is also a partially assembled end view of the blank depicted in FIG. 7 showing the dust flaps turned inwardly.

FIG. 10 is an end view of the completely assembled blank as depicted in FIG. 7 showing the dust flaps in broken lines.

FIG. 11 is a transverse sectional view of the assembled blank of the alternate embodiment showing the transparent membrane in a shrunken condition.

FIG. 12 is a sectional view taken as on the line XII—XII of FIG. 11.

DESCRIPTION OF THE PREFERRED EMBODIMENT

Figure 1:
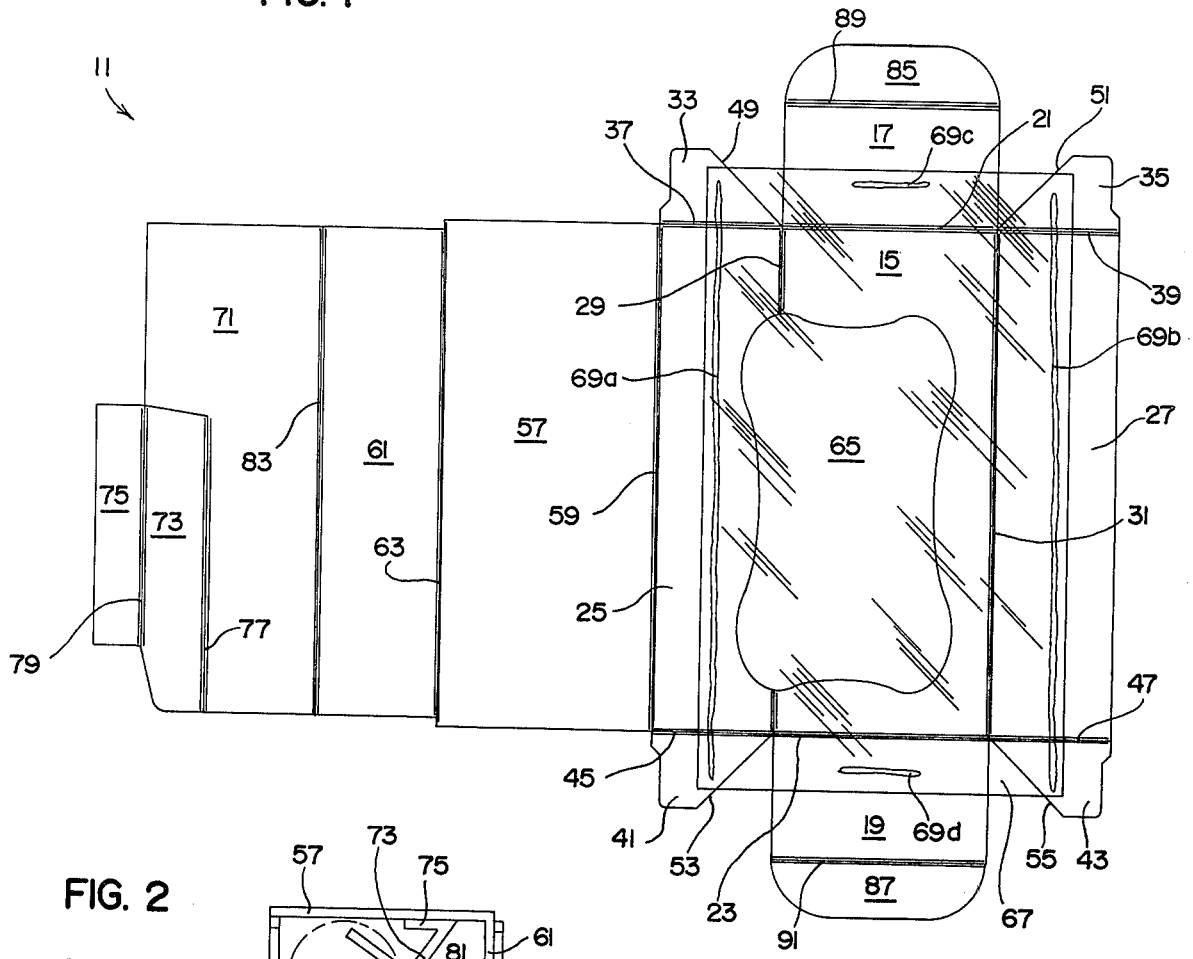
FIG. 1 is a plan view of a blank incorporating the invention.
Figure 4:
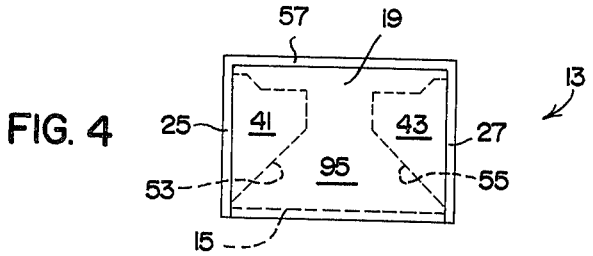
FIG. 4 is an end view of the completely assembled blank as depicted in FIG. 1 with the dust flaps being shown in broken lines therein.
Figure 5:
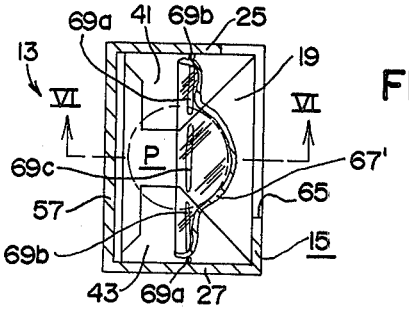
FIG. 5 is a transverse sectional view of the assembled blank of the principal embodiment showing the transparent membrane in a shrunken condition, the shelf structure being deleted for clarity.

The blank 11 of the present invention for producing the carton 13 herein disclosed is clearly shown in FIG. 1 of the drawings, the assembled carton 13 being clearly shown in FIGS. 4 and 5 of the drawings. The blank 11 includes a front wall panel 15 having a pair of closure flap panels 17, 19 disposed at either end thereof, the closure flap panels 17, 19 being hingedly attached to the front wall panel 15 along respective closure flap panel fold lines 21, 23. Also included are a pair of side wall panels 25, 27 disposed along either side of the front wall panel 15 and being hingedly attached thereto along respective side wall panel fold lines 29, 31. Also included are a first pair of triangular shaped dust flap panels, as at 33, 35, respectively disposed at one of the ends of the side wall panels 25, 27 and being hingedly attached thereto along respective first dust flap panel fold lines 37, 39.

The blank 11 also includes a second pair of triangular shaped dust flap panels 41, 43 respectively disposed at the ends of the side wall panels 29, 31 which are remote from the previously mentioned one of the ends thereof and as clearly shown in FIG. 1 of the drawings. The dust flap panels 41, 43 are hingedly attached to the respective side wall panels 25, 27 along second dust flap panel fold lines 45, 47. The first and second pairs of triangular shaped dust flap panels 33, 35; 41, 43 respectively have diagonally extending free side margins thereto, as at 49, 51; 53, 55, which extend radially outward from the respective corners of the front wall panel 15 as clearly shown in FIG. 1 of the drawings.

The blank 11 also includes a rear wall panel 57 disposed along one side of one of the pair of side wall panels, e.g., the side wall panel 25, and is hingedly attached thereto along a rear wall panel fold line 59. The blank 11 also includes glue flap means, e.g., a flap 61, for fixedly attaching certain of the panels of the blank 11 one to the other when assembling the blank, i.e., to produce the carton 13. The glue flap panel 61 is shown hingedly attached to the rear wall panel 57 along a glue flap panel fold line 63, however, the panel 61 may, if desired, be disposed adjacent the side wall panel 27. It should be understood that the above-mentioned fold lines 21, 23, 29, 32, 37, 39, 45, 47, 59 and 63 as well as other fold lines yet to be mentioned, may alternately be referred to as score lines since they are preferably formed by a scoring technique in a manner well known to those skilled in the art.

The blank 11 also includes a window opening 65 defined at least in part by portions of the front wall panel 15, i.e., the window opening 65 may optionally extend into either or both of the side wall panels 25, 27 if desired. Additionally, a transparent heat shrinkable membrane 67 is included and overlies the following inner surfaces: The entire front wall panel 15; portions of the pair of closure flap panels 17, 19; portions of the pair of side wall panels 25 27; portions of the first pair of triangular shaped dust flap panels 33, 35; and portions of the second pair of triangular shaped dust flap panels 41, 43. The function of the membrane 67 is for forming a transparent barrier a spaced distance inwardly from the window opening 65 and for pulling the side wall panels 25, 27; the dust flap panels 33, 35, 41, 43; and the closure flap panels 17, 19 jointly inwardly when the blank 11 has been assembled into the carton 13 and the membrane 67 has subsequently been heat shrunk in a manner well known to those skilled in the art, e.g., as disclosed in the above-mentioned Struble '337 patent.

The blank 11 also includes a plurality of adhesive means, as at 69, for fixedly attaching certain portions of the transparent heat shrinkable membrane 67 to predetermined portions of the inner surfaces of the pair of closure flap panels 17, 19; the pair of side wall panels 25, 27; the first pair of triangular shaped dust panels 33, 35; and the second pair of triangular shaped dust flap panels 41, 43, i.e., the plurality of adhesive means 69 are individually designated as **69*a*, 69*b*, 69*c*,** etc., for purposes which will be more apparent as the specification proceeds.

From FIG. 1 of the drawing it may readily be seen that the just-mentioned predetermined portions of the inner surfaces of the pair of closure flap panels 17, 19; the pair of side wall panels 25, 27; the first pair of triangular shaped dust flap panels 33, 35; and the second pair of triangular shaped dust flap panels 41, 43 include portions which are mutually spaced outwardly from the perimeter of the front wall panels 15.

Further, the adhesive means 69 includes a first pair of parallel spaced apart adhesive portions, as at **69*a*, 69*b*, respectively overlying portions of the side wall panels 25, 27 and the first and second pairs of triangular shaped dust flap panels 33, 35; 41, 43. More specifically, the first pair of adhesive portion 69*a*, 69*b* substantially extend respectively from the diagonal side margins 49, 51 of the pair of dust flap panels 33, 35 to the diagonal side margins 53, 55 of the pair of dust flap panels 41, 43. Further yet, a second pair of adhesive portions, as at 69*c*, 69*d*, extend substantially parallel with the closure panel fold lines 21, 23 and which overlie respective mid portions of the closure flap panels 17, 19. The second pair of adhesive portions 69*c*, 69*d* respectively have lengths thereto which are less than half the lengths of the closure panel fold lines 21, 23. As previously mentioned, the first and second pairs of adhesive portions 69*a*, 69*b*; 69*c*, 69*d* are mutually spaced outwardly from the perimeter of the front wall panels 15.**

From FIG. 1 of the drawings it may clearly be seen that the lengths of the second pair of adhesive portions **69*c*, 69*d* respectively are substantially one-third the lengths of the closure panel fold lines 21, 23 with the second adhesive portions 69*c*, 69*d* being disposed in the central one-third of the closure flap panels 17, 19.**

Figure 2:
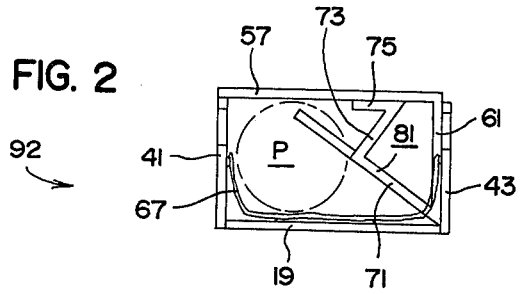
FIG. 2 is an end view of the partially assembled blank depicted in FIG. 1 showing a product in phantom lines suitably positioned therein and being supported by shelf structure.

The blank 11 preferably includes a plurality of shelf-forming panels, e.g., the panels 71, 73, 75 hingedly connected one to the other along shelf-forming fold lines 77, 79, for forming shelflike means, as at 81 in FIG. 2 of the drawings. When the blank 11 has been assembled, the shelflike means 81 supports certain products characterized by the capital letter P which may be contained within the carton 13. The plurality of shelf-forming panels 71, 73, 75 preferably are hingedly attached, as shown, to the rear wall panel 57 along a shelf-structure attaching fold line 83. It will be understood that variations in the exact shape of the shelflike means 81 are contemplated depending upon the physical nature of the product P withhout departing from the spirit and scope of the invention. It will be further understood that the shelflike means 81 may be omitted if desired.

From FIG. 1 of the drawings it may clearly be seen that the pair of closure flap panels 17, 19 respectively constitute a pair of straight tuck flap panels which are well known to those skilled in the art. More specifically, the straight tuck flap panels 17, 19 respectively include tab portions, as at 85, 87 which are defined in part by respective tab fold lines 89, 91.

The carton 13 of the present invention is produced by the blank 11 by preferably performing the following steps: First, the side wall panels 25, 27 are folded upwardly along the respective score lines 29, 31, as best shown in FIG. 4 of the drawings.

Second, the rear wall panel 57 is folded donwardly along the scored line 59, to the position shown in FIG. 2 of the drawings.

Third, the glue flap panel 61 is folded downwardly along the score line 63 with the side wall panel 27 overlappingly engaging the flap 61, to the position best shown in FIG. 2 of the drawings. The panels 27, 61 are fixedly attached one to the other in any well known manner, e.g., as with adhesives (not shown) or the like.

Fourth, the shelflike means 81 is formed by folding the panel 71 along the scored line 83, to a position best shown in FIG. 2, and folding the panels 73, 75 respectively along the scored lines 77, 79 so that the panel 75 contiguously engages a portion of the rear wall panel 57. The panel 75 preferably is fixedly attached to the rear wall panel 57 in any well known manner, e.g., as with adhesives (not shown) or the like. Accordingly, the above-mentioned steps 1 through 4 produce a tubular sleeve, as at 92 in FIG. 2, having the shelflike means 81 contained therein for suitably receiving the product P. It should be noted that at this point the membrane 67 is flexible, i.e., the membrane 67 assumes no particular shape or conformity with respect to the product P until experiencing an application of heat.

Figure 3:
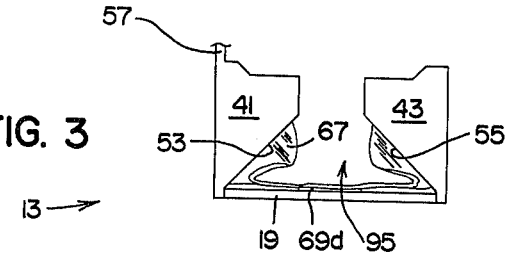
FIG. 3 is also an end view of the partially assembled blank as depicted in FIG. 1 with the dust flaps being folded inwardly.
Figure 6:
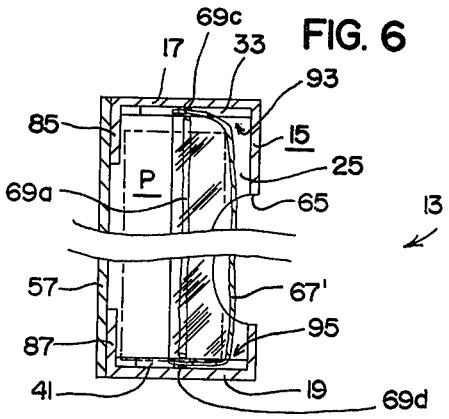
FIG. 6 is a sectional view taken as on the line VI—VI of FIG. 5.

The fifth step in producing the carton 13 includes folding the dust flap panels 33, 35; 41, 43 inwardly to the respective positions clearly shown for the second pair of dust flap panels 41, 43 in FIG. 3 of the drawings. In the process of completing step 5, a pair of prominent spaces, as at 93, 95, are established which respectively are disposed at either end of the front wall 15 and are subjacent the respective closure flap panels 17, 19. The prominent spaces 93, 95 assure that the heat shrinkable membrane 67 is unrestrained in proximity to the entire perimeter of the front wall 15 and is free to totally pull away from the front wall 15 as it is being shrunk. It should be understood that the prominent space 93 is substantially identical to the prominent space 95 which is clearly shown in FIGS. 3, 4 and both prominent spaces 93, 95 are generally indicated in FIG. 6 of the drawing. The prominent space 95 is defined by the margins 53, 55 of the respective panels 41, 43 and a portion of the front wall panel 15, as clearly shown in FIGS. 3, 4. It should be noted that the shelflike means 81 has been deleted from the carton 13 in FIGS. 3 through 6 of the drawings.

The sixth step in producing the carton 13 from the blank 11 includes folding the closure flap panels 17, 19 inwardly along the respective scored lines 21, 23 and tucking the respective tab portions 85, 87 inwardly to the positions clearly shown in FIG. 6 of the drawings, i.e., folding the respective tabs 85, 87 inwardly along the scored lines 89, 91.

The seventh step for producing the carton 13 from the blank 11 includes exposing the assembled carton having the product P contained therein to a source of heat, e.g., like that clearly described in the Struble '337 patent or the like. Accordingly, the heat shrinkable membrane 67 assumes the position clearly shown in FIGS. 5 and 6 of the drawings and character referenced therein by the numeral 67'. Therefore, the carton 13 is now substantially pilfer proof. Secondly, it holds the product P securely in place. Third, the product P is visible through the window opening 65 and the transparent membrane 67. Fourth, the strength of the carton 13 is considerably stronger than prior staight tuck cartons since the front wall panels 15; closure flaps 17, 19; the side walls 25, 27; and the rear wall panel 57 are all tied together by the membrane 67. Fifth, the product P is substantially protected against dust accumulating thereon. Sixth, the product P is maintained in optimum orientation. Seventh, the product P is suspended toward the center of the carton 13 affording protection thereof, i.e., against breakage of fragile products.

The prominent spaces 93, 95 are important features of the present invention since the prior straight tuck cartons having the usual rectangular shaped dust flaps would not reliably enable the membrane 67 to pull away from the front wall paper 15, i.e., in the area adjacent the prominent spaces 93, 95. Therefore, the prominent spaces 93, 95 provide positive assurance that the heat shrinkable membrane 67 is unrestrained in proximity to the ends of the front wall 15 and that it is free to be pulled inwardly from the front wall as it is being shrunk, as clearly depicted in FIGS. 5 and 6 of the drawings by the numeral 67'. Accordingly, the dust flap panels 33, 35, 41, 43 preferably are triangular in shape to provide an optimum size and shape for the prominent spaces 93, 95. However it should be understood that the dust flap panels 33, 35, 41, 43 may have shapes other than triangular shapes, the object being to remove predetermined portions thereof to establish the prominent spaces 93, 95 in order to assure that the membrane 67 is not pinched between the closure flap panel 17 and the dust flaps 33, 35 and/or the closure flap panel 19 and the dust flap panels 41, 43, i.e., when assembling the carton 13.

Another embodiment of the carton and blank for producing same is herein disclosed, i.e., the second embodiment of the blank is character referenced herein by the numeral 11' and the carton produced thereby is character referenced by the numeral 13'. The blank 11' is clearly depicted in FIG. 7 of the drawings. Additionally, the carton 13' is clearly depicted in FIGS. 10 through 13 of the drawings. Further, the steps for assembling the blank 11' into the carton 13' are depicted in FIGS. 8 and 9 of the drawings. The structure of the blank 11' and/or the carton 13' which is identical to that of the principle embodiment will be identified by identical numerals. Additionally, the structure of the alternate embodiment which is similar to that of the principle embodiment will be identified by the same numeral with a prime suffix. The blank 11' is herein disclosed with the shelf forming structure being deleted therefrom. However, it should be understood that the shelf forming structure as previously disclosed for the principle embodiment may alternately be included with the blank 11' without departing from the spirit and scope of the present invention. The glue flap means 61' and the score lines 63', rather than being disposed adjacent the rear wall panel 57, are disposed adjacent the side wall panel 27, i.e., the flap 61 is hingedly attached to the side wall panel 27 along the glue flap panel fold line 63'.

The blank 11' includes the closure flap panels 17', 19' which differ slightly from the principle embodiment in that the respective tab portions 85, 87 have been deleted therefrom. The blank 11' also includes a pair of auxiliary closure flap panels 17'', 19'' which are disposed at either end of the rear wall panel 57 and are hingedly attached thereto along auxiliary closure flap panel fold lines 101, 103 respectively. More specifically, the pair of closure flap panels 17', 19' and the pair of auxiliary closure flap panels 17'', 19'' jointly constitute a first pair of seal end panels, as at 105, for seal end closing one end of the assembled blank 11' and a second pair of seal end panels, as at 107, for seal end closing the opposite end of the assembled blank 11'. Accordingly, the closure flap panels 17', 19' are inner flap panels while the auxiliary closure flap panels 17'', 19'' are outer flap panels.

The steps for producing the carton 13' from the blank 11' are very similar to the steps above described for the principle embodiment. The fourth steps which involved forming the shelf means 81 is deleted from the alternate embodiment. The third step varies slightly in that the flap 61 contiguously engages a portion of the rear wall panel 57 and is fixedly attached thereto in any well known manner, e.g., as with adhesive (not shown) or the like. The sixth step varies slightly in that the first pair of seal end panels 105 are folded inwardly along the respective fold lines 21, 101, i.e., with the closure flap panel 17'' overlappingly engaging the closure flap panel 17'. Additionally, the second pair of seal end panels 107 are folded inwardly along the respective fold lines 23, 103, i.e., the closure flap panel 19'' overlappingly engaging the closure flap panel 19''. The closure flap panels 17'', 19'' are fixedly attached, in any well known manner as by adhesives (not shown) or the like, to the respective inner closure flap panels 17', 19'. Accordingly, the carton herein disclosed, either the principle or alternate embodiment thereof, will purposely sustain damage as a result of an attempt to pilfer the product P therefrom.

Although the invention has been described and illustrated with respect to preferred embodiments thereof, it is to be understood that it is not to be so limited since changes and modifications may be made therein which are within the full intended scope of the invention.

I claim:

1. A carton for holding certain products, said carton comprising front and rear walls joined along the lengths thereof by a pair of side walls, a window opening defined at least in part by portions of said front wall, a pair of dust flaps respectively having free side margins cooperating with closure flap means for establishing and closing each end of said carton; and transparent heat-shrinkable membrane means enclosing said window opening and having peripheral segments thereof secured to predetermined portions of each of said side walls, said dust flaps, and said closure flap means for restraining the product in optimum orientation subsequently to said heat-shrinkable membrane means being shrunk and also for minimizing pilferage of the product by tying together and jointly pulling said pair of side walls, said dust flaps, and said closure flap means inwardly; whereby said carton will purposely sustain damage as a result of an attempt to pilfer the product therefrom; said dust flaps respectively being triangular in shape to provide further assurance that said pair of side walls, said dust flaps, and said closure flap means are all firmly pulled jointly inwardly, said triangular shaped dust flaps and said front wall jointly defining a pair of prominent spaces respectively disposed at either end of said front wall and subjacent said closure flap means, whereby said heat-shrinkable membrane means if unrestrained in proximity to the entire perimeter of said front wall and is free to totally pull away from said front wall as it is being shrunk.

2. A carton for holding certain products, said carton comprising front and rear walls joined along the lengths thereof by a pair of side walls, a window opening defined at least in part by said front wall, a pair of dust flaps cooperating with closure flap means for establishing and closing each end of said carton, said dust flaps and said front wall jointly defining a pair of prominent spaces respectively disposed at either end of said front wall and being subjacent said closure flap means; and transparent heat shrinkable membrane means enclosing said window opening and having peripheral segments thereof secured to predetermined portions of each of said side walls, said dust flaps, and said closure flap means for engaging and restraining the product in optimum orientation subsequently to said heat shrinkable membrane means being shrunk and also for minimizing pilferage of the product by tying together and jointly pulling said pair of side walls, said dust flaps, and said closure flap means inwardly; said pair of prominent spaces providing assurance that said heat shrinkable membrane means is unrestrained in proximity to the ends of said front wall and that it is free to be pulled inwardly from said front wall as it is being shrunk, whereby said carton will purposely sustain damage as a result of an attempt to pilfer the product therefrom.

3. The carton of claim 2 in which said dust flaps are triangular in shape to provide optimum size and shape for said pair of prominent spaces, thus further assuring that said pair of side walls, said dust flaps, and said closure flap means are all firmly pulled jointly inwardly.

4. A blank for producing a carton, said blank comprising a front wall panel, a pair of closure flap panels disposed at either end of said front panel and being hingedly attached thereto along respective closure flap panel fold lines, a pair of side wall panels disposed along either side of said front wall panel and being hingedly attached thereto along respective side wall panel fold lines, a first pair of triangular shaped dust flap panels respectively disposed at one of the ends of said side wall panels and being hingedly attached thereto along respective first dust flap panel fold lines, a second pair of triangular shaped dust flap panels respectively disposed at the ends of said side wall panels which are remote from said one of the ends thereof and being hingedly attached thereto along second dust flap panel fold lines, said first and second pairs of triangular shaped dust flap panels respectively having diagonally extending side margins thereto which extend radially outwardly from the respective corners of said front wall panel, a rear wall panel disposed along one side of one of said pair of side wall panels and being hingedly attached thereto along a rear wall panel fold line, glue flap means for fixedly attaching certain of said panels of said blank one to the other when assembling said blank, a window opening defined at least in part by portions of said front wall panel; a transparent heat shrinkable membrane overlying inner surfaces of said front wall panel, portions of said pair of closure flap panels, said pair of side wall panels, and said first and second pairs of triangular shaped dust flap panels for forming a transparent barrier a spaced distance inwardly from said window opening and for pulling the side wall panels, the dust flap panels, and the closure flap panels jointly inwardly when the blank has been assembled into a carton and the membrane has subsequently been heat-shrunk; and adhesive means for fixedly attaching certain portions of said transparent heat shrinkable membrane to predetermined portions of the inner surfaces of said pair of closure flap panels, said pair of side wall panels, and said first and second pairs of triangular shaped dust flap panels.

5. The blank as described in claim 4 in which said predetermined portions of the inner surfaces of said pair of closure flap panels, said pair of side wall panels, and said first and second pairs of triangular shaped dust flap panels include portions which are mutually spaced outwardly from the perimeter of said front wall panel.

6. The blank as described in claim 4 in which said adhesive means includes a first pair of parallel spaced apart adhesive portions respectively overlying portions of said side wall panels and said first and second pairs of triangular shaped dust flap panels, said first pair of adhesive portions substantially extending respectively from said diagonal side margins of one of said pair of dust flap panels to said diagonal side margins of the other of said pair of dust flap panels, and a second pair of adhesive portions which extend substantially parallel with said closure panel fold lines and which overlie respective midportions of said closure flap panels, said second pair of adhesive portions respectively having lengths thereto which are less than half the lengths of said closure panel fold lines, said first and second pairs of adhesive portions being mutually spaced outwardly from the perimeter of said front wall panel.

7. The blank as described in claim 6 in which the lengths of said pair of second adhesive portions respectively are substantially one third the lengths of said closure panel fold lines being disposed in the central one third of said closure flap panels.

8. The blank as described in claim 4 in which is included a plurality of shelf forming panels hingedly connected one to the other along shelf forming fold lines for forming shelflike means when assembling the blank to subsequently support certain products intended to be contained within the carton, said plurality of shelf forming panels being hingedly attached to said rear wall panel along a shelf structure attaching fold line.

9. The blank as described in claim 4 in which said pair of closure flap panels respectively constitute a pair of straight tuck flap panels.

10. The blank as described in claim 4 in which is included a pair of auxiliary closure flap panels disposed at either end of said rear wall panel and being hingedly attached thereto along auxiliary closure flap panel fold lines respectively.

11. The blank as described in claim 10 in which said pair of closure flap panels and said pair of auxiliary closure flap panels jointly constitute a first pair of seal end panels for seal end closing one end of the assembled blank and a second pair of seal end panels for seal end closing the opposite end of the assembled blank.

12. The carto of claim 2 in which is included a shelf-like member disposed within said carton for supporting the produuct contained therein in a display manner within proximity to said window.

* * * * *